US006341848B1

(12) United States Patent
Shade et al.

(10) Patent No.: US 6,341,848 B1
(45) Date of Patent: Jan. 29, 2002

(54) FLUID-JET PRINTER HAVING PRINTHEAD WITH INTEGRATED HEAT-SINK

(75) Inventors: David A. Shade, Boise; John B. Rausch, Meridian, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/459,999

(22) Filed: Dec. 13, 1999

(51) Int. Cl.[7] ..... B41J 2/05
(52) U.S. Cl. ..... 347/63; 347/64
(58) Field of Search ..... 347/63, 64, 67, 347/56, 54, 20

(56) References Cited

U.S. PATENT DOCUMENTS

| | | | | |
|---|---|---|---|---|
| 2,801,375 A | | 7/1957 | Losco | 257/763 |
| 3,431,468 A | | 3/1969 | Huffman | 257/508 |
| 3,518,494 A | | 6/1970 | James | 257/539 |
| 3,640,782 A | | 2/1972 | Brown et al. | 438/553 |
| 3,909,319 A | | 9/1975 | Fujiwara et al. | 430/62 |
| 3,930,260 A | | 12/1975 | Sicking | 347/68 |
| 4,542,401 A | | 9/1985 | Sekiba | 257/717 |
| 4,578,687 A | | 3/1986 | Cloutier et al. | 347/44 |
| 4,616,408 A | * | 10/1986 | Lloyd | 347/64 |
| 4,677,447 A | | 6/1987 | Nielsen | 347/87 |
| 4,943,816 A | | 7/1990 | Sporer | 346/25 |
| 4,956,653 A | | 9/1990 | Braun | 347/64 |
| 5,068,697 A | | 11/1991 | Noda et al. | 257/315 |
| 5,175,613 A | | 12/1992 | Barker, III et al. | 257/713 |
| 5,294,826 A | | 3/1994 | Marcantonio et al. | 257/659 |
| 5,371,404 A | | 12/1994 | Juskey et al. | 257/659 |
| 5,473,112 A | | 12/1995 | Doi | 174/35 R |
| 5,486,848 A | * | 1/1996 | Ayata et al. | 347/56 |
| 5,560,837 A | | 10/1996 | Trueba | 216/27 |
| 5,589,711 A | | 12/1996 | Sano et al. | 257/718 |
| 5,670,420 A | | 9/1997 | Choi | 38/643 |
| 5,706,039 A | | 1/1998 | Chamberlain et al. | 347/47 |
| 5,751,316 A | | 5/1998 | Bailey et al. | 347/63 |

FOREIGN PATENT DOCUMENTS

| | | | |
|---|---|---|---|
| EP | 0445688 | 9/1991 | B41J/2/05 |

* cited by examiner

*Primary Examiner*—John Barlow
*Assistant Examiner*—Juanita Stephens

(57) ABSTRACT

A printhead is used to eject printing fluid, such as ink, onto a printing medium. This printhead has an integrated heat-sink used to cool energy dissipation elements which propel the printing fluid from the printhead. The printhead includes an amorphous substrate carrying a structure of plural thin-film layers. Upon the substrate is defined a metallic heat sink layer covering substantially the entire plan-view shape of the substrate, and serving during operation of the printhead to distribute excess heat for dissipation. During manufacturing of the printhead, this thin-film metallic heat sink layer performs the additional function of preventing an element or compound present in the substrate from migrating into the thin-film layers.

37 Claims, 3 Drawing Sheets

FLUID-JET PRINTER HAVING PRINTHEAD WITH INTEGRATED HEAT-SINK

BACKGROUND OF THE INVENTION

1. Field of the Invention

This invention relates generally to thermal inkjet printing. More particularly, this invention relates to an inkjet printhead apparatus having a dual-function heat sink, and to a method for manufacturing such an inkjet printhead. The dual-function heat sink of the present printhead is used during operation of the inkjet printhead to cool a resistor, or other energy-dissipation device. Such a resistor or other energy-dissipation device is used to eject fluid from the fully integrated fluid-jet printhead. During manufacturing of this inkjet printhead, the dual-function heat sink is used as a barrier preventing a chemical element or compound which is present in a substrate of the printhead from migrating by diffusion or other transport mechanism to another structure of the printhead.

2. Related Technology

Inkjet printers or plotters typically have a printhead mounted on a carriage. This carriage traverses back and forth across the width of a print medium (i.e., usually paper or a plastic plotting film, for example) as the medium is fed through the printer or plotter. Orifices on the printhead are fed ink (or other printing fluid) by one or more channels communicating from a reservoir. Energy applied individually to addressable resistors (or other energy-dissipating elements, for example, to piezoelectric actuators), transfers energy to ink which is within or associated with selected orifices, causing a portion of the ink to momentarily convert to vapor phase and to form a vapor bubble. Thus, this type of printer is also sometimes referred to as a "bubble jet printer." As a result of the formation and expansion of the bubble, some of the ink is ejected out of the respective orifice toward the print medium (i.e., forming an "ink jet"). As the ink is ejected, the bubble collapses almost simultaneously, allowing more ink from the reservoir to fill the channel. This quick ejection of an ink jet from an orifice, and almost simultaneous collapse of the bubble which caused this ejection, allows for the ink jet printing cycle to have a high repetition rate.

Customer demands and competitive pressures continue to create a desire for faster ink jet printing combined with higher resolution. Thus, there is a strong desire in the inkjet printing art to increase the repetition rate at which ink can be ejected from a printhead. Increasing the repetition rate requires that more energy be applied to the resistors in the printhead, thereby causing the printhead to dissipate more heat, and possibly to become hotter. However, if the printhead becomes too hot, the ink will not be ejected from the printhead properly. That is, if the printhead becomes too hot, the ink may not be ejected in the proper amount, or perhaps not at all. This failure to properly eject ink from the printhead is sometimes referred to as a "misfire," and causes poor print quality.

In addition, misfiring may cause the printhead to quit functioning at a particular print orifice because it is possible for the electrical resistor to open-circuit. This open circuiting of a printing resistor is similar to blowing a fuse, and can result from excessive temperature buildup at the printing resistors. This type of failure creates a permanent loss of printing ability at that orifice location of the printhead. Such a loss of printhead function is a terrible inconvenience to the user as the ink jet printing cartridge must be replaced, even though it may be nearly full of ink. Therefore, it is very important to more efficiently remove heat generated by the resistors or other energy dissipating elements of an ink jet printhead.

Another factor which works against cooling the resistors or other energy dissipating elements of an inkjet printhead is the pursuit of higher print densities. Higher print densities result in higher resolution in the characters of a printed document, or in an image, and make possible the reproduction of near-photographic quality inkjet images. However, as the resolution of an inkjet printhead increases, the amount of ink ejected during each firing of an orifice needs to be reduced. That is, the volume of ink in each "ink jet" ejected onto the print medium is decreased, making a greater number of firing cycles necessary to print a particular character or image. Further, the adjacent orifices are moved closer together. This increase in closeness of the adjacent orifices and their respective resistors or other energy dissipation elements, means that during operation of the printhead more energy is dissipated in a smaller volume of material. Thus, the amount of space and mass which is available to move the residual heat away from the energy dissipation elements or resistors is reduced.

In view of the above, it is seen that faster printing, higher print density and improved resistor cooling are all desirable improvements for an ink jet printhead.

Conventional ink jet print heads are seen in U.S. Pat. Nos. 3,930,260; 4,578,687; 4,677,447; 4,943,816; 5,560,837, and 5,706,039. However, none of these conventional ink jet printheads is believed to offer the combination, arrangement, and cooperation of components that is achieved in the present printhead. Particularly, none of these conventional printheads have a heat sink structure that also serves as a diffusion barrier during manufacturing of the printhead.

Additional conventional technology related to making semiconductor structures, or to making or using thin-film structures is know according to U.S. Pat. Nos. 2,801,375; 3,431,468; 3,518,494; 3,640,782; 3,909,319; 4,542,401; 5,068,697; 5,175,6133; 5,294;826; 5,371,404; 5,473,112; 5,589,711; 5,670,420; and 5,751,316. However, with the exception of the '316 patent, none of this conventional technology is believed to related to an inkjet printhead. The '316 patent is believed also to relate to a printhead based on silicon (or other semiconductor) processing technology,

SUMMARY OF INVENTION

In view of the deficiencies of the related technology, an object for this invention is to reduce or overcome one or more of these deficiencies.

Accordingly, the present invention provides an integrated ink jet printhead for ejecting printing fluid, this printhead comprising a substrate having a plan-view shape; a thin-film structure carried on the substrate, the thin-film structure including a metallic heat sink layer adjacent to the substrates, the metallic heat sink layer having a plan-view shape substantially the same as and congruent with the plan-view shape of the substrate; whereby the heat sink layer covers substantially the entire plan-view shape of the substrate.

According to another aspect, this invention provides a method of making an integrated thermal fluid jet print head, this method comprising steps of: forming a substrate having a plan-view shape; forming a thin-film structure on the substrate; including in the thin-film structure adjacent to the substrate a metallic heat sink layer; and forming the metallic heat sink layer to have a plan-view shape substantially the same as and congruent with the plan-view shape of the substrate, whereby the heat sink layer covers substantially the entire plan-view shape of the substrate.

Still another aspect of the present invention provides a printhead for ejecting printing fluid, the printhead comprising an amorphous substrate, a thin-film structure carried on the substrate; and a thin-film radio-frequency shield layer interposed between the substrate and the thin-film structure, whereby, the radio-frequency shield layer substantially prevents sodium, another chemical element, or chemical compound from transporting from the substrate to the thin-film structure during exposure of the substrate and thin film structure to radio frequency energy.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

Figure 2:
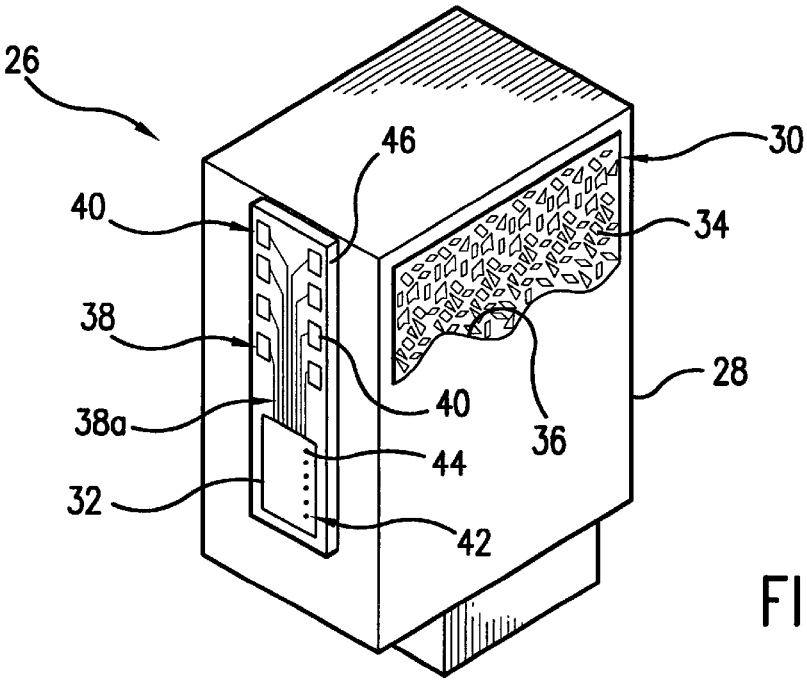
FIG. 2 shows an exemplary inkjet print cartridge which may be used in the printer of FIG. 1, and which includes an inventive printhead embodying the present invention.
Figure 3:
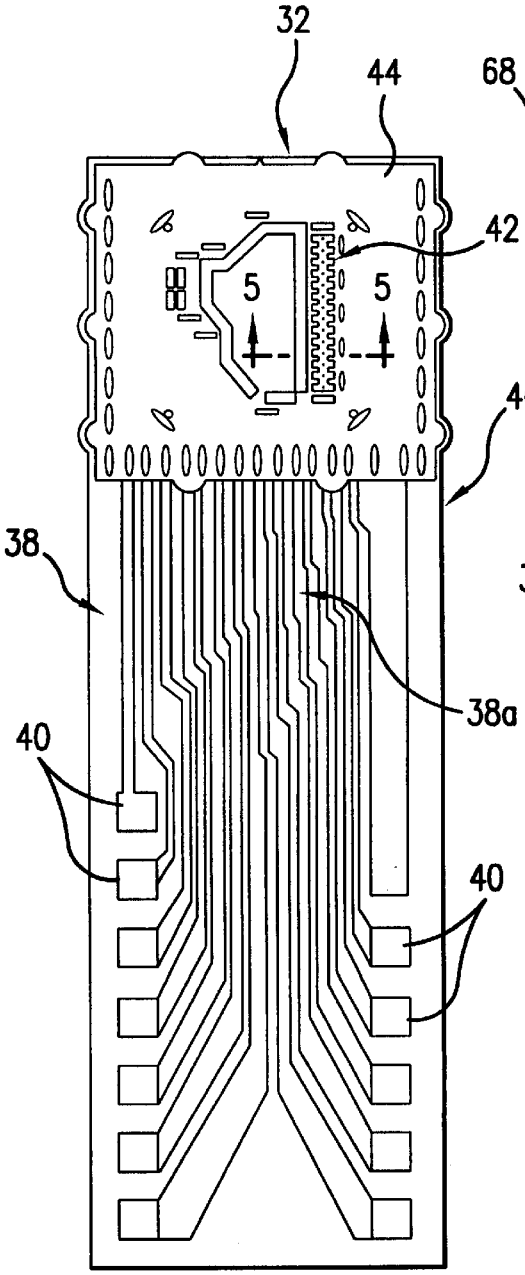
Figure 4:
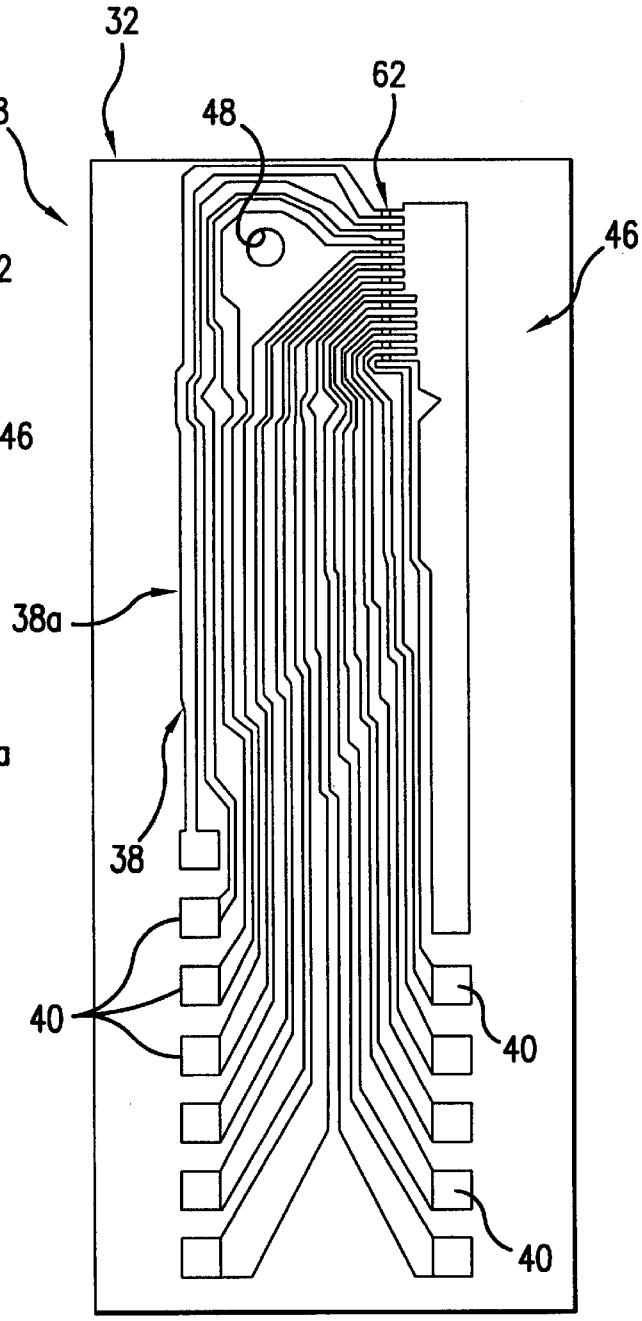
Figure 5:
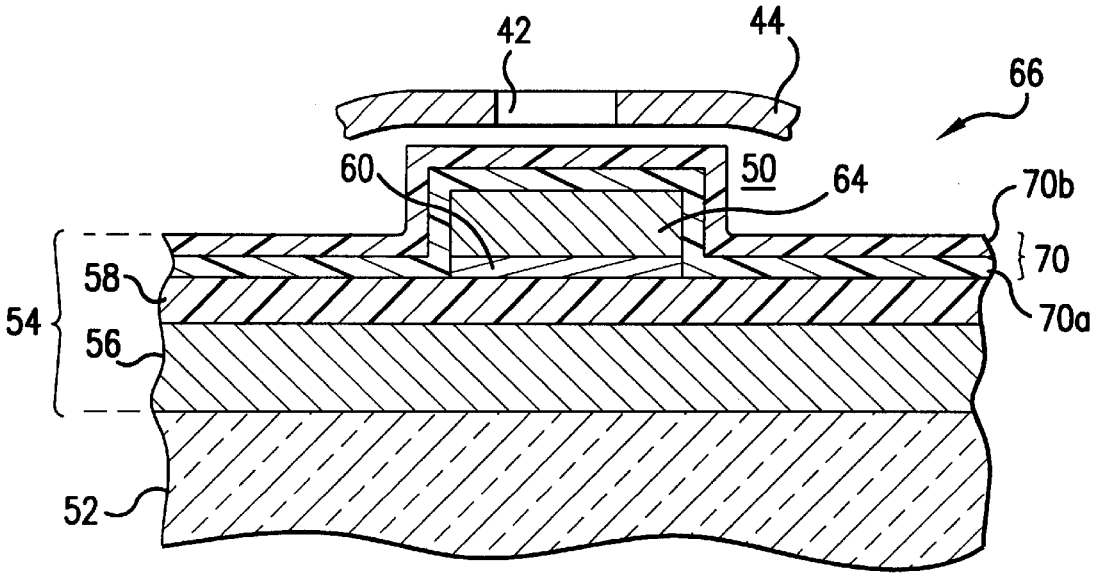
Figure 6:
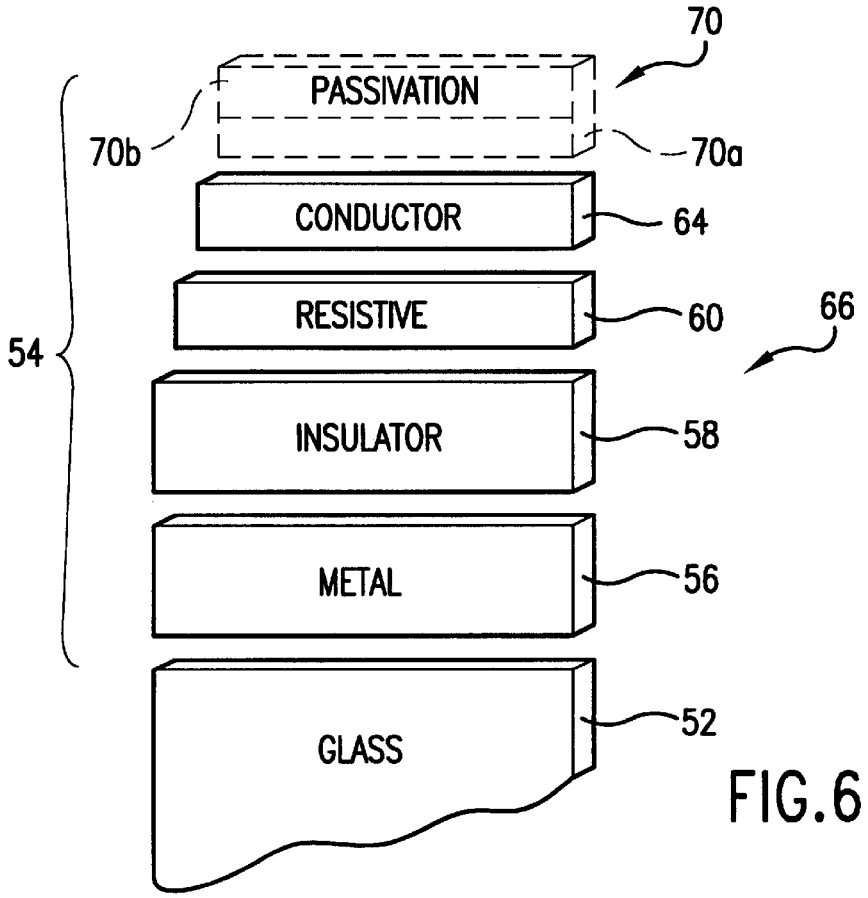

FIG. 3 provides a plan-view of a printhead portion of the inkjet print cartridge seen in FIG. 2;

FIG. 4 is a plan-view similar to FIG. 3, of the inkjet print cartridge, and has portions removed for clarity of illustration;

FIG. 5 provides a somewhat diagrammatic fragmentary cross sectional view taken at the line 5—5, and is shown greatly enlarged in comparison to the illustration of FIG. 4;

FIG. 6 is a diagrammatic cross sectional view of a portion of a printhead embodying the present invention, and during a stage of the manufacturing process, and is similar to the portion seen in FIG. 5;

DETAILED DESCRIPTION OF THE PREFERRED EXEMPLARY EMBODIMENT OF THE INVENTION

Figure 1:
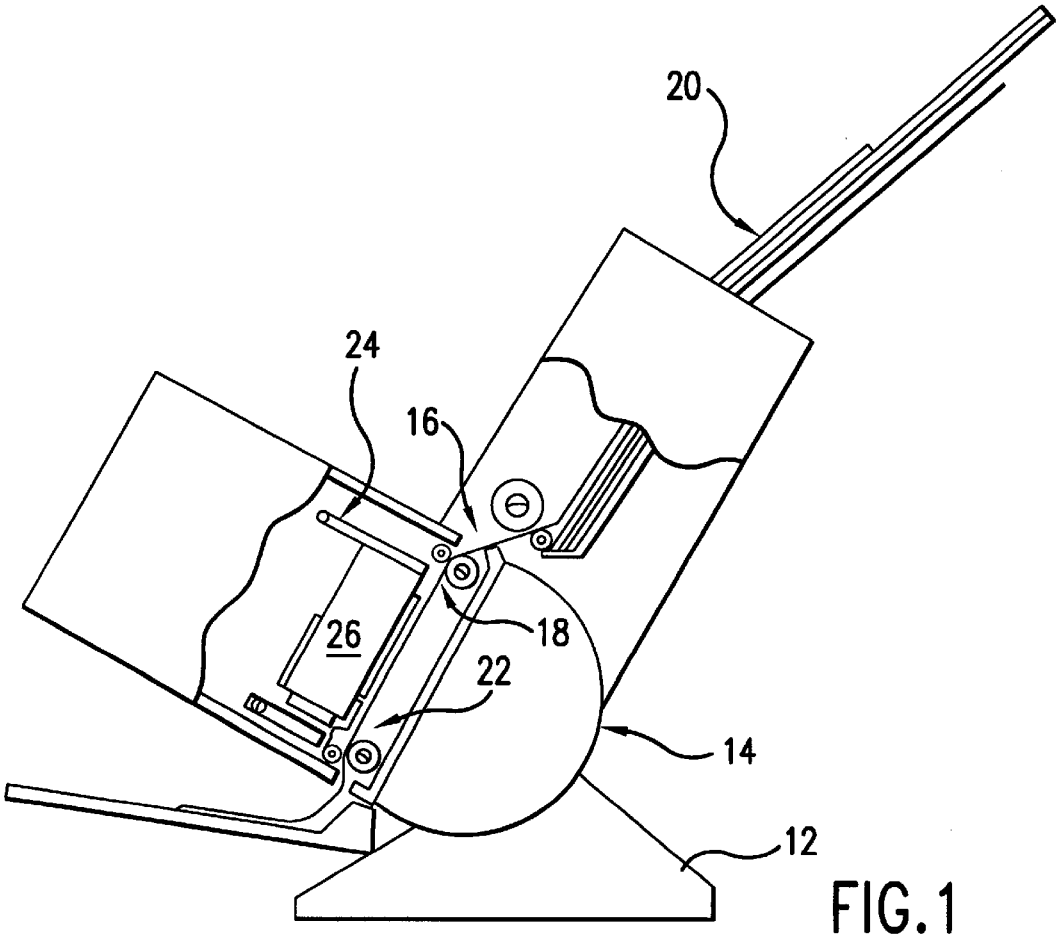
FIG. 1 is a diagrammatic side elevation view of an exemplary inkjet printer which uses an exemplary inkjet print cartridge with a printhead embodying the present invention.

FIG. 1 shows an exemplary inkjet printer 10. This printer 10 includes a base 12 carrying a housing 14. Within the housing 14 is a feed mechanism 16 for controllably moving a print medium (i.e., paper) through the printer 10. The feed mechanism 16 controllably moves a sheet of paper 18 from a paper magazine 20 along a print path 22 within the printer 10. The printer 10 includes a traverse mechanism 24 carrying an inkjet print cartridge 26. The traverse mechanism moves the inkjet printing cartridge 26 perpendicularly to the direction of movement of the paper 18 (i.e., the cartridge 26 is moved perpendicularly to the plane of FIG. 2). The printer uses the inkjet printing cartridge 26 to controllably place small droplets of printing fluid (i.e., ink, for example) from the inkjet printing cartridge 26 on the paper 18. By moving the inkjet printing cartridge 26 repeatedly back and forth across the paper 18 as this paper is advanced by the feed mechanism 16, characters or images may be controllably formed by ejection of the small droplets of ink from the cartridge 26. These small droplets of ink are ejected in the form of ink jets impinging on the paper 18 in controlled locations to form characters and images, as will be well known to those ordinarily skilled in the pertinent arts.

FIG. 2 illustrates the exemplary inkjet printing cartridge 26. This inkjet printing cartridge 26 includes a cartridge body 28, which defines a fluid delivery assembly (generally referenced with the numeral 30) supplying printing fluid (such as ink) to a printhead 32. The printhead 32 is carried by the printing cartridge body 28. The fluid delivery assembly 30 may include a sponge 34 carried within a chamber 36 of the body 28, and a standpipe (not shown), conveying the printing fluid from the chamber 36 to the printhead 32. The printhead 32 includes a printing circuit 38 which electrically couples the printhead 32 via circuit traces 38*a* and electrical contacts 40 with the printer 10. That is, the electrical contacts 40 individually make electrical contact with matching contacts (not seen in the drawing Figures) on the traverse mechanism 24, and provide for electrical interface of the printhead 32 with electrical driving circuitry (also not illustrated in the drawing Figures) of the printer 10. Individual fine-dimension orifices 42 of the printhead 32 eject printing fluid when appropriate control signals are applied to contacts 40. The fine-dimension orifices 42 are formed in a metallic plate member 44 adhesively attached to underlying structure (generally referenced with the numeral 46, and seen in FIG. 4) of the printhead 32. As is seen in FIG. 4, the underlying structure 46 of the printhead 32 defines a through hole 48 communicating printing fluid from the chamber 36 to a cavity 50 (best seen in FIG. 5) formed between the structure 46 and a portion of the plate member 44.

The structure of the printhead 32 is shown in FIGS. 3–6 viewed in conjunction with one another. The thermal ink jet printhead 32 of FIGS. 3–6 includes a substrate 52 (best seen in FIGS. 5 and 6), which is most preferably formed as a plate of glass (i.e., an amorphous, generally non-conductive material). In this exemplary preferred embodiment, the substrate 52 is generally rectangular in plan view, although the invention is not so limited. Most preferably, this glass substrate is an inexpensive type of soda/lime glass (i.e., like ordinary window glass), which makes the printhead 32 very economical to manufacture, The printhead 32 is especially economical and inexpensive to manufacture when considered in comparison to printheads using the conventional technologies requiring a substrate of silicon or other crystalline semiconductor materials.

On the glass substrate 52 is formed a thin-film structure 54 of plural layers. As will be further explained, during manufacturing of the printhead 32 this thin-film structure 54 is formed substantially of plural thin-film layers applied one after the other and atop of one another, and each of which entirely covers and is congruent with the plan-view shape of the substrate. Again, this plan-view shape of the substrate 52 is seen in FIGS. 3 and 4. Once selected ones of these thin-film layers are formed on the substrate 52, subsequent patterning and etching operations are used to define the contacts 40 and print circuit 38, for example, as is further explained below.

The thin-film structure 54 includes a metallic multi-function heat sink, radio frequency shield, and diffusion barrier thin-film layer 56 (best seen in FIGS. 5 and 6) which is applied upon the substrate 52. The layer 56 covers the entire plan-view shape of the substrate 52, and is preferably formed of chrome about 1 to 2 microns thick. Alternatively, the layer 56 may be formed of other metals and alloys. For example, the thin-film heat sink, RF shield, and diffusion barrier layer 56 may be formed of aluminum, chrome, copper, gold, iron, molybdenum, nickel, palladium, platinum, tantalum, titanium, tungsten, a refractory metal, or of alloys of these or other metals.

Upon the metallic thin-film layer 56 is formed an insulator thin-film layer 58. The insulator layer 58 is preferably formed of silicon oxide, and is about 1 to 2 microns thick. Again, this insulator layer 58 covers and is congruent with the entire plan-view shape of the substrate 52.

Next, on the substrate 52 and on the insulator layer 56, is formed a resistor thin-film layer 60. The thin-film resistor layer is preferably formed of tantalum, aluminum alloy, and is preferably about 600 Angstroms thick. This resistor thin-film layer 60 is formed to cover and be congruent with the entire plan-view shape of the substrate 52, but does not remain this extensive. That is, the resistor layer 60 is later patterned and etched back until it covers only an area congruent with the traces 38*a* of the print circuit 38, with each of the contacts 40, and with each one of plural print resistor areas 62 (best seen in FIG. 5, and generally indicated with the arrowed numeral 62 on FIG. 4).

Over the unpatterned and unetched resistor layer 60 is next formed a metallic conductor thin-film layer 64. This metallic conductor thin-film layer 64 is formed preferably of an aluminum based alloy, and is about 0.5 micron thick. Again, this metallic conductor layer 64 is initially formed to cover and be congruent with the entire plan-view shape of the substrate 52. However, this conductor layer 64 is also later patterned and etched back to cover only the area defining the traces 38*a* of print circuit 38, and defining the contacts 40. More particularly, the conductor layer 64 is first etched away at the location of the print resistors 62 so that a portion of the thin-film resistor layer 60 spanning between traces 38*a* of the print circuit 38 provides the only conduction path between these traces. Later, the etching operation is carried further, removing both the conductive layer 64 and the underlying resistive layer 60 over the entire plan-view shape of the substrate 52, except at the locations of the traces 38 and contact pads 40. This etching operation leaves the traces 38*a* and contact pads 40 standing in relief on the insulative layer 58, as can be appreciated from a study of FIG. 5.

Accordingly, an in view of the above, it will be understood that during operation of the printhead 32 when a current is applied between two of the contacts 40 leading via traces 38*a* to opposite sides of one of the print resistors 62, the current to and from the respective print resistor 62 is carried in the traces of the print circuit 38 by a combination of the conductor thin-film layer 64 and the underlying resistor thin-film layer 60. Because the conductive layer 64 has a much lower resistance than the resistive layer 60, most of this current will flow in the layer 64. However, at the print resistor 62 itself only the underlying resistor layer 64 is available to carry the current (the overlying conductive layer 64 having been locally etched away). The print resistors 62 are fine-dimension areas of the resistive layer 60. Thus, these print resistors 62 can be caused to quickly dissipate energy, and to liberate heat. However, also viewing FIG. 3 and recalling that the metallic heat sink layer 56 covers substantially the entire plan-view shape of the substrate 52, it will be understood that this heat sink layer both underlies the resistors 62 to absorb heat from these resistors, and has a large area (i.e., essentially the entire plan-view area of the printhead 32) from which to dissipate excess heat. Thus, the printhead 32 during operation maintains a desirably low temperature, and can operate at firing repetition rates not possible with conventional printheads using a glass substrate.

As FIG. 6 illustrates in fragmentary cross sectional view, a first manufacturing intermediate article 66 results from the above described manufacturing steps prior to the patterning and etching steps described above, and prior to the formation of the through hole 48. This first manufacturing intermediate article includes the substrate 52, and the thin-film layers 56, 58, 60, and 64, each of which substantially covers and is congruent with the entire plan-view shape of the substrate 52. This first manufacturing intermediate article 66 is subjected to the patterning and etching processes described above to produce a second manufacturing intermediate article 68, substantially as is seen in FIGS. 4 and 5. On this second manufacturing intermediate article 68 is formed a pair of passivating thin-film layers 70, as is best seen in FIG. 5, and which are indicated on FIG. 6 with dashed lines. This passivating thin-film layer 70 includes a first sub-layer 70*a* of silicon nitride, followed by a second sub-layer 70*b* of silicon carbide. As FIG. 5 illustrates fragmentarily, the completion of the printhead 32 requires only the adhesive attachment of the metallic plate member 44, with the print orifices 42 in alignment with the print resistors 62.

In view of the above, those ordinarily skilled in the pertinent arts will understand that the thin-film structure 54 may be formed on the substrate 52 using a variety of techniques. These techniques including, but are not limited to, sputtering, and plasma enhanced chemical vapor deposition (PECVD) (i.e., physical vapor deposition. See, Thin-film Processes II, J. L. Vossen & W. Kern, editors, Academic Press, New York, 1991, ch. 2–4). During one or more of these deposition processes, the workpiece that will become the first and second manufacturing intermediate articles, and which will become a completed printhead 32, may be subjected to radio frequency energy. Particularly during the formation of the passivating layers 70*a* and 70*b*, the second manufacturing intermediate article 68 is exposed to elevated temperatures and to radio frequency energy to assist in the deposition of these layers. During this exposure of the article 68 to radio frequency energy at elevated temperature, the metallic heat sink layer 56 serves as a radio-frequency shield, possibly preventing the localized heating of areas of the substrate that have comparatively higher conductivity, and preventing sodium or another chemical element or compound that is present in the soda/lime glass substrate 52 from being transported into the other thin-layer structures of the printhead. Particularly, were this sodium, other chemical element, or compound, not prevented from being partially transported into the passivation layer 70, the sodium or other chemical element or compound could cause a lesion in the passivation layer at which this layer would not long withstand the cavitation occurring in the printing fluid each time a bubble collapses after an ink jet ejection. However, because the heat sink layer 56 covers the entire plan-view shape of the printhead 32, there is no place where sodium, another chemical element, or compound, from the glass substrate 52 can be transported (perhaps by diffusion, for example) into the thin-film structures above this metallic heat sink layer 56. Thus, contamination of the thin-film structure 54 with sodium, with another chemical element, or with a chemical compound from the glass substrate 52 is prevented in the present invention.

Those skilled in the art will further appreciate that the present invention may be embodied in other specific forms without departing from the spirit or central attributes thereof. Because the foregoing description of the present invention discloses only particularly a preferred exemplary embodiment of the invention, it is to be understood that other variations are recognized as being within the scope of the present invention. Accordingly, the present invention is not limited to the particular embodiment which has been described in detail herein. Rather, reference should be made to the appended claims to define the spirit and scope of the present invention.

What is claimed is:

1. A printhead comprising: a substrate having a plan view shape; a thin-film structure with radio-frequency shield capabilities, carried on said substrate, said thin-film structure including a metallic heat sink layer adjacent to said substrate, said metallic heat sink layer having a plan view shape substantially the same as and congruent with the plan view shape of said substrate; whereby said heat sink layer covers substantially the entire plan-view shape of the substrate.

2. The printhead of claim 1 wherein said substrate is formed of glass.

3. The printhead of claim 1 wherein said metallic heat sink layer is formed of a metal selected from the group consisting of: aluminum, chrome, copper, gold, iron, molybdenum, nickel, palladium, platinum, tantalum, titanium, tungsten, a refractory metal, and alloys of these or other metals.

4. A printhead comprising:

a glass substrate having a plan-view shape;

a thin-film structure carried on said glass substrate, said thin-film structure including a metallic heat sink layer adjacent to said glass substrate, said metallic heat sink layer having a plan-view shape substantially the same as and congruent with the plan-view shape of said glass substrate;

whereby said heat sink layer covers substantially the entire plan-view shape of said glass substrate;

wherein said thin-film structure includes a passivation layer, and said passivation layer is substantially free of sodium, another chemical element, or compound migrated from said glass substrate;

whereby said metallic heat sink layer substantially prevents said sodium, said another chemical element, or said compound from said glass substrate from migrating into said passivation layer.

5. The printhead of claim 4 wherein said thin-film structure includes: said metallic heat sink layer interfacing with said substrate; an insulative layer interfacing with said metallic heat sink layer; a resistive layer interfacing with said insulative layer; a conductive layer interfacing with said resistive layer; and said passivation layer.

6. The printhead of claim 5 wherein said insulative layer includes silicon oxide.

7. The printhead of claim 5 wherein said resistive layer includes tantalum aluminum alloy.

8. The printhead of claim 5 wherein said conductive layer includes aluminum.

9. A fluid printing cartridge for ejecting printing fluid onto a printing medium, said printing cartridge comprising:

a cartridge body defining a printing fluid chamber, and a printing fluid delivery assembly;

a printhead having an amorphous substrate with a plan-view shape; said print head receiving printing fluid from said printing fluid chamber via said printing fluid delivery assembly and controllably ejecting this printing fluid onto the printing medium, said printhead including:

a thin-film structure with radio-frequency shield capabilities, carried on said substrate and including a metallic heat sink layer adjacent to said substrate and having a plan-view shape substantially the same as and congruent with the plan-view shape of said substrate.

10. The printing cartridge of claim 9 wherein said substrate is formed of glass.

11. The printing cartridge of claim 9 wherein said metallic heat sink layer is formed of a metal selected from the group consisting of: aluminum, chrome, copper, gold, iron, molybdenum, nickel, palladium, platinum, tantalum, titanium, tungsten, a refractory metal, and alloys of these or other metals.

12. A fluid jet printer, said printer comprising:

a base carrying a housing defining a printing path, a print medium feed mechanism controllably moving print medium through said printer along said printing path, a traverse mechanism carrying a fluid jet print cartridge for movement generally transversely to said printing path, said fluid jet print cartridge including:

a cartridge body defining a printing fluid chamber, and a printing fluid delivery assembly;

a printhead having an amorphous substrate with a plan-view shape; said print head receiving printing fluid from said printing fluid chamber via said printing fluid delivery assembly and controllably ejecting this printing fluid onto the printing medium, said printhead including: a thin-film structure with radio-frequency shield capabilities, carried on said substrate and including a metallic heat sink layer adjacent to said substrate and having a plan-view shape substantially the same as and congruent with the plan-view shape of said substrate.

13. The fluid jet printer of claim 12 wherein said substrate of said printhead is formed of glass.

14. The fluid jet printer of claim 12 wherein said metallic heat sink layer of said printheads is formed of a metal selected from the group consisting of: aluminum, chrome, copper, gold, iron, molybdenum, nickel, palladium, platinum, tantalum, titanium, tungsten, a refractory metal, and alloys of these or other metals.

15. A fluid jet printer, said printer comprising:

a base carrying a housing defining a printing path, a print medium feed mechanism controllably moving print medium through said printer along said printing path, a traverse mechanism carrying a fluid jet print cartridge for movement generally transversely to said printing path, said fluid jet print cartridge including:

a cartridge body defining a printing fluid chamber, and a printing fluid delivery assembly;

a printhead having an amorphous substrate with a plan-view shape; said print head receiving printing fluid from said printing fluid chamber via said printing fluid delivery assembly and controllably ejecting this printing fluid onto the printing medium, said printhead including:

a thin-film structure carried on said substrate and including a metallic heat sink layer adjacent to said substrates and having a plan-view shape substantially the same as and congruent with the plan-view shape of said substrate wherein said thin-film structure includes: said metallic heat sink layer interfacing with said substrate; an insulative layer carried upon said metallic heat sink layer; a resistive layer carried upon said insulative layer; a conductive layer carried upon said resistive layer; and a passivation layer.

16. The fluid jet printer of claim 15 wherein said insulative layer includes silicon oxide, said resistive layer includes tantalum aluminum alloy, and said conductive layer includes aluminum.

17. A method of making an integrated thermal fluid jet print head, said method comprising steps of:

forming a substrate having a plan-view shape;

forming a thin-film structure with radio-frequency shield capabilities, on said substrate;

including in said thin-film structure adjacent to said substrate a metallic heat sink layer; and forming said metallic heat sink layer to have a plan-view shape substantially the same as and congruent with said plan-view shape of said substrate, whereby said heat sink layer covers substantially the entire plan-view shape of said substrate.

18. The method claim 17 further including the step of substantially making said substrate of glass.

19. The method of claim 17 further including the step of making said metallic heat sink layer of a metal selected from the group consisting of: aluminum, chrome, copper, gold, iron, molybdenum, nickel, palladium, platinum, tantalum, titanium, tungsten, a refractory metal, and alloys of these or other metals.

20. A method of making an integrated thermal fluid jet printhead, said method comprising steps of:

forming an amorphous substrate;

forming a thin-film structure on said substrate;

including in said thin-film structure a passivation layer;

including in said thin film structure a metallic heat sink layer; and, keeping said passivation layer substantially free of sodium migrated from said glass substrate by employing radio-frequency shield capabilities in said metallic heat sink layer to substantially prevent migration of sodium from said amorphous substrate into said passivation layer.

21. The method of claim 20 further including the step of making said amorphous substrate of glass.

22. The method of claim 20 further including the step of making said metallic heat-sink layer of metal selected from the group consisting of: aluminum, chrome, copper, gold, iron, molybdenum, nickel, palladium, platinum, tantalum, titanium, tungsten, a refractory metal, and alloys of these or other metals.

23. The method of claim 20 further including the step of including in said thin-film structure a means for heat dissipation.

24. A printhead for ejecting printing fluid, said printhead comprising:

an amorphous substrate;

a thin-film structure carried on said substrate; and a thin-film radio-frequency shield layer interposed between said substrate and said thin-film structure;

whereby said radio-frequency shield layer substantially prevents sodium, another chemical element, or chemical compound from transporting from said substrate to said thin-film structure during exposure of said substrate and thin film structure to radio frequency energy.

25. The printhead of claim 24 wherein said substrate is formed of glass.

26. The printhead of claim 24 wherein said thin-film radio frequency shield layer is formed of a metal selected from the group consisting of: aluminum, chrome, copper, gold, iron, molybdenum, nickel, palladium, platinum, tantalum, titanium, tungsten, a refractory metal, and alloys of these or other metals.

27. The printhead of claim 24 wherein said thin-film structure includes a passivation layer, and said passivation layer is substantially free of sodium, another chemical element, or compound transported from said glass substrate;

whereby said thin-film radio frequency shield layer substantially prevents sodium, another chemical element, or compound from said glass substrate from transporting into said passivation layer during radio frequency exposure of said substrate and thin-film structure.

28. The printhead of claim 27 wherein said thin-film structure includes: an insulative layer interfacing with said thin-film radio frequency shield layer; a resistive layer interfacing with said insulative layer; a conductive layer interfacing with said resistive layer; and said passivation layer.

29. The printhead of claim 28 wherein said insulative layer includes silicon oxide.

30. The printhead of claim 28 wherein said resistive layer includes tantalum aluminum alloy.

31. The printhead of claim 28 wherein said conductive layer includes aluminum.

32. A method of making a fluid jet printhead, said method comprising steps of:

forming an amorphous substrate;

forming a thin-film structure on said substrate;

interposing between said thin-film structure and said substrate a radio frequency shield thin-film layer; and utilizing said radio frequency shield layer to substantially prevent transport of sodium, another chemical element, or compound, from said amorphous substrate to said thin-film structure.

33. The method of claim 32 further including the step of making said amorphous substrate of glass.

34. The method of claim 32 further including the step of making said radio frequency shield thin-film layer of metal selected from the group consisting of: aluminum, chrome, copper, gold, iron, molybdenum, nickel, palladium, platinum, tantalum, titanium, tungsten, a refractory metal, and alloys of these or other metals.

35. A printhead comprising: a nonconductive substrate which is electrically and thermally insulative, said substrate having a plan view shape; a thin-film structure carried on said substrate, said thin-film structure including a metallic electrically and thermally conductive heat sink layer adjacent to and in contact with said substrate, said metallic heat sink layer having a plan view shape substantially the same as and fully congruent with said plan view shape of said substrate; whereby said heat sink layer covers substantially the entire plan-view shape of the substrate.

36. A fluid printing cartridge for ejecting printing fluid onto a printing medium, said fluid printing cartridge comprising:

a cartridge body defining a printing fluid chamber, and a printing fluid delivery assembly;

a printhead having an amorphous nonconductive substrate which is electrically and thermally insulative, said substrate defining a plan-view shape; said print head receiving printing fluid from said printing fluid chamber via said printing fluid delivery assembly and controllably ejecting this printing fluid onto the printing medium, said printhead including:

a thin-film structure carried on said substrate and including a metallic electrically and thermally conductive heat sink layer adjacent to and in contact with said substrate, said heat sink layer having a plan-view shape substantially the same as and congruent with the plan-view shape of said substrate.

37. A fluid jet printer, said printer comprising:

a base carrying a housing defining a printing path, a print medium feed mechanism controllably moving print medium through said printer along said printing path, a traverse mechanism carrying a fluid jet print cartridge for movement generally transversely to said printing path, said fluid jet print cartridge including:

a cartridge body defining a printing fluid chamber, and a printing fluid delivery assembly;

a printhead having an amorphous nonconductive substrate which is electrically and thermally insulative, said substrate defining a plan-view shape; said print head receiving printing fluid from said printing fluid chamber via said printing fluid delivery assembly and controllably ejecting this printing fluid onto the printing medium, said printhead including:

a thin-film structure carried on said substrate and including a metallic heat sink layer which is electrically and thermally conductive, said heat sink layer being adjacent to and in electrical and thermal contact with said substrate, and said heat sink layer further having a plan-view shape substantially the same as and congruent with the plan-view shape of said substrate.

* * * * *